United States Patent [19]

Ahn et al.

[11] Patent Number: 4,912,143

[45] Date of Patent: Mar. 27, 1990

[54] RESIN COMPOSITION FOR ABSORBING ELECTROMAGNETIC WAVES

[75] Inventors: Tae O. Ahn; Kyoung N. Park, both of Seoul; Beom S. Kim, Kyungki, all of Rep. of Korea

[73] Assignee: Tong Yang Nylon Co., Ltd., Seoul, Rep. of Korea

[21] Appl. No.: 234,678

[22] Filed: Aug. 22, 1988

[30] Foreign Application Priority Data

Jun. 22, 1988 [KR] Rep. of Korea ..... 88-7507

[51] Int. Cl.[4] ..... G21F 1/10

[52] U.S. Cl. ..... 523/137; 524/141; 524/143; 524/285; 524/413; 219/10.55 D

[58] Field of Search ..... 523/137; 219/10.55 D; 524/413, 141, 285

[56] References Cited

U.S. PATENT DOCUMENTS

| | | | |
|---|---|---|---|
| 3,742,176 | 6/1973 | Ishino et al. | 219/10.55 |
| 3,866,009 | 2/1975 | Ishino et al. | 219/10.55 |
| 4,003,840 | 1/1977 | Ishino et al. | 252/62 |
| 4,046,983 | 9/1977 | Ishino et al. | 219/10.55 |
| 4,602,141 | 7/1986 | Naito et al. | 219/10.55 |
| 4,785,148 | 11/1988 | Mayer | 219/10.55 D |

FOREIGN PATENT DOCUMENTS

| | | | |
|---|---|---|---|
| 0062252 | 10/1982 | European Pat. Off. | 523/137 |

*Primary Examiner*—Lewis T. Jacobs

*Attorney, Agent, or Firm*—Oblon, Spivak, McClelland, Maier & Neustadt

[57] ABSTRACT

A resin composition containing potassium based single crystal fibers for absorbing electromagnetic waves.

5 Claims, 4 Drawing Sheets

RESIN COMPOSITION FOR ABSORBING ELECTROMAGNETIC WAVES

TECHNICAL FIELD

The present invention relates to a resin composition for absorbing electromagnetic waves. More specifically, the present invention relates to a microwave absorber which is used as a gasket for preventing microwave or heating energy leaking from gaps between the oven body and the door of microwave heating ovens used for cooking food, and especially to the electromagnetic wave absorbable resin composition, having excellent heat-resistance and mechanical strength and improved absorbing effects of microwaves.

BACKGROUND OF THE INVENTION

In general, microwave heating ovens are frequently utilized for heating articles including foods within a comparatively short time. For heating articles in an oven microwaves of 2450 MHz are usually generated. The high frequency waves thus generated, i.e. microwaves, are apt to leak out from the gaps between the oven body and the door. Such leakage of microwaves causes disturbance of electromagnetic waves in the household appliances, such as radio and TV and may cause harm to the human body. For such reasons, the use of the microwave absorber, which can prevent the leakage of microwaves from the gap between the oven body and the door of microwave heating ovens is needed.

Until now, many patents disclosed means for preventing the leakage of microwaves from microwave heating ovens. For example, U.S. Pat. Nos. 3,742,176 and 3,866,009 disclosed the use of ferromagnetic materials prepared by mixing ferrite powder of formula $MFe_2O_4$, wherein M is Ni, Cu, Zn, Mn or Mg, with a high molecular weight organic polymers selected from natural rubbers and synthetic rubbers.

In U.S. Pat. No. 4,046,983 there was reported a method for preparing microwave absorbers which comprises mixing a ferrite powder with an organic high molecular weight materials selected from synthetic rubbers, thermoplastic resins and thermosetting resins; and in U.S. Pat. No. 4,003,840 a method for preparation of microwave absorbers by mixing a ferrite powder having a particle size of less than 1.65 mm and the general formula $MFe_2O_4$ in which M is Mn, Ni, Cu, Zn, Mg or Co, with an organic high molecular weight material selected from the group consisting of thermosetting resins (phenolic resins, polyester resins, epoxy resins, silicone resins), thermoplastic resins (PVC, polyethylene, polypropylene), and natural and synthetic rubbers (polychloroprene, acrylonitrile-butadiene-styrene, fluorine-containing rubbers), has been disclosed. In addition, U.S. Pat. No. 4,602,141 proposed a method for producing a microwave absorber which comprises mixing ferrite powder (Mn,Zn,Fe-ferrite powder or Mn,Cu,Zn-ferrite powder), carbon powder and a high molecular polymer.

However, the microwave absorbers produced by utilizing these conventional methods and compositions do not provide a satisfactory level of heat-resistance and mechanical strength. Particularly, when the microwave absorber is mounted on the microwave heating oven and used for a long time, the durability of the microwave absorber is significantly reduced according to the accumulation of operating time thereof, i.e. with the passage of time in which the microwave heating oven is operated. Thus, there is a drawback in that the microwave absorbing effect (attenuation effect) or heat energy insulating effect is relatively lowered.

Accordingly, the present inventors have extensively researched microwave absorbers providing the solution to the aforementioned problems and thus now have invented a microwave absorber having improved microwave absorbing effect (attenuation effect) and heat energy insulating effect from those of the conventional absorbers as well as more improved heat-resistance and mechanical strength.

BRIEF DESCRIPTION OF THE INVENTION

The present invention provides a resin composition for absorbing electromagnetic waves which comprises 3 to 5 parts by weight of a ferrite powder and 0.5 to 1.5 part by weight of a polymer mixture, said ferrite powder having the general formula $M_1O.M_2O.Fe_2O_3$ in which $M_1$ and $M_2$ are divalent metal selected from the group consisting of Cu, Zn, Mn, Mg, Ni and Co, and being produced by a mutual combination of $M_1$ and $M_2$.

DETAILED DESCRIPTION OF THE INVENTION

Figure 1:
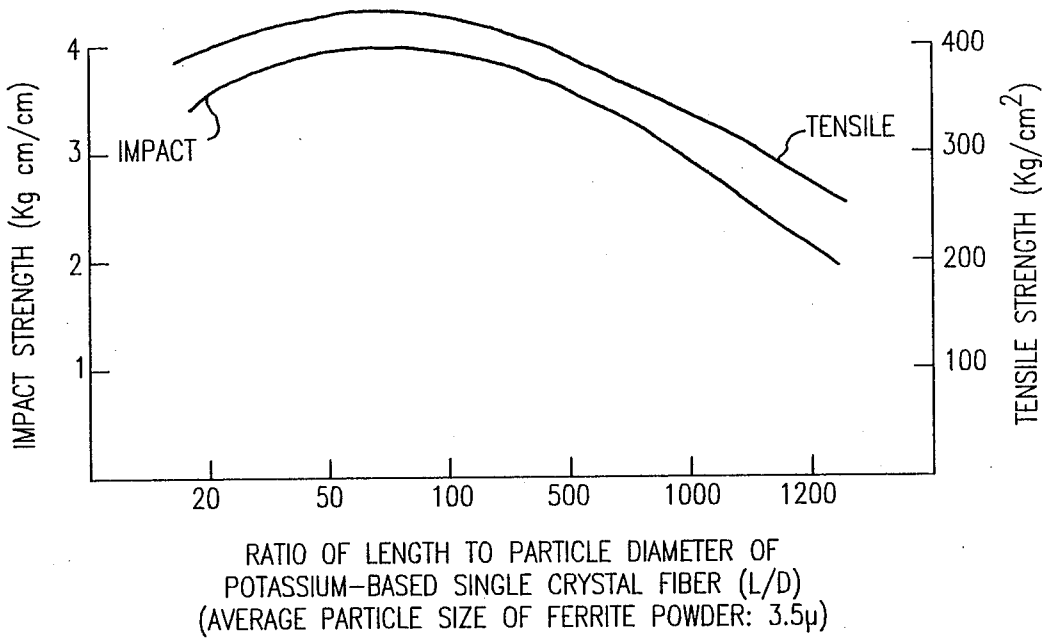
FIGS. 1 and 3 are diagrams showing mechanical strength of potassium-based single crystal fibers used in the microwave absorber of the present invention.

The present invention will be specifically illustrated in the following. That is, a composition for preparing the microwave absorber of the present invention is composed of 3 to 5 parts by weight of a ferrite powder having particle size below 100μ and 0.5 to 1.5 part by weight of an organic high polymer mixture, said ferrite powder being represented by the general formula; $M_1O.M_2O.Fe_2O_3$ in which $M_1$ and $M_2$ are divalent metal such as Cu, Zn, Mn, Mg, Ni, Co, etc., and produced by a mutual combination of $M_1$ and $M_2$.

In the above, the organic high polymer mixture is prepared by mixing 100 parts by weight of an organic high polymer composition formed by mixing 0.1 to 1 part by volume of a modified polypropylene resin and 3 to 5 parts by volume of a polypropylene resin in the original form, with 0.5 to 2 parts by weight of a potassium-based single crystal fiber having a ratio (L/D) of length to diameter in the range of 20 to 100.

In addition, the aforementioned modified polypropylene resin is prepared by mixing together 90 to 97% by weight of a polypropylene resin, 1 to 5% by weight of an acid compound containing carboxyl radical, 1 to 5% by weight of a peroxide compound and 1 to 5% by weight of a phosphate-based stabilizer.

The potassium-based single crystal fiber as mentioned above is in the form of a white needle crystal and is a material, having excellent heat-resistance (melting point: 1300°–1350° C.) and mechanical strength (tensile strength: above 700 kg/mm$^2$), which is usually referred to as potassium hexatitanate whisker ($K_2O.\ 6TiO_2$). The purpose of the addition of such fiber resides particularly in improvements in mechanical strength of the microwave absorber which thus extends the usable life thereof. For such purpose a length to diameter ratio for this fiber within the range of 20 to 100 is preferable.

Specific examples of the acid compounds having carboxy radical, which is used for the preparation of the modified polypropylene resin in the present invention, include cis-4-cyclohexane-1,2-carboxylic acid, cis-4-cyclohexane-1,2-dicarboxylic acid anhydride, endo-cis-bicyclo(2,2,1)-5-heptene-2,3-dicarboxylic acid, endo-cis-bicyclo(2,2,1)-5-heptene-2,3-dicarboxylic acid anhydride, endo-cis-bicyclo(2,2,1)-1,2,3,4,7,7-hexachloro-2-heptene-5,6-dicarboxylic acid, endo-cis-bicyclo(2,2,1)-1,2,3,4,7,7-hexachloro-2-heptene-5,6-dicarboxylic acid anhydride, maleic anhydride, etc. Examples of the peroxide compounds are aromatic diacyl peroxide, aliphatic diacyl peroxide, dibasic acid peroxide, ketone peroxide, dicumyl peroxide, di-tert.-butyl peroxide, 2,5-dimethyl-2,5-di(tert.-butyl peroxy) hexane, 2,5-dimethyl-2,5-di(tert.-butyl peroxy) hexine-3,1,3-bis(-tert.-butyl peroxy isopropyl) benzene, benzoyl peroxide, tert.-butyl peroxy-isopropyl carbonate, diacetyl peroxide, lauroyl peroxide, tert.-butylcumyl peroxide, etc. As examples of the phosphate-based stabilizers, tributoxyethylphosphate, tricresylphosphate, trioctylphosphate, triethylphosphate, triphenylphosphate, etc., can be mentioned.

The aforementioned composition of the present invention consisting of ferrite powder and the organic high polymer mixture can be molded into a microwave absorber having a specific shape by use of the conventional extrusion of injection molding method.

It can be seen that the microwave absorber prepared from the composition of the present invention exhibits excellent microwave absorbing effect and heat energy insulating effect as well as improvements in heat-resistance and mechanical strength, in comparison with the microwave absorbers prepared by previously known methods. The present invention will be more specifically illustrated in the following examples, but should not be limited to these specific examples.

EXAMPLE 12.5 parts by weight of ZnO, 20 parts by weight of MnO and 67.5 parts by weight of $Fe_2O_3$ are mixed in a ball mill for 40 hours and then the mixture is compression molded at a pressure above 1 ton/cm$^2$ to form a flat plate of the size 150×200×5 mm. The plate is then heated at 1350° C. for 2 hours or longer to sinter. The resulting sintered shaped body, i.e. Mn-Zn-ferrite, is pulverized using a stamp mill to give two kinds of ferrite powder, of which the average particle sizes are 3.5μ and 70μ, respectively.

The Mn-Zn-ferrite powder thus obtained is mixed with the organic high polymer mixture, which is composed of the potassium-based single crystal fiber (TISMO made by Otsuka Chemical Co., Japan) and the organic high polymer composition, in a ratio of 4 parts by weight:1 part by weight and then the mixture is injection molded to form a conventional microwave absorber shape ( ⊓⊔ ).

The said organic high polymer composition is a mixture of 1 part by volume of the modified polypropylene resin and 4 parts by volume of the polypropylene resin in the original form, said modified polypropylene resin being the particle having a diameter of particle of 2 mm to 3 mm and a length of 3 mm to 4 mm, which is prepared by introducing into a biaxial kneader 90% by weight of polypropylene resin, 3% by weight of cis-4-cyclohexane-1,2-dicarboxylic acid anhydride, 4% by weight of an aliphatic diacyl peroxide and 3% by weight of trioctylphosphate and then kneading the mixture at the processing temperature of 220° to 250° C. while maintaining the interior of a cylinder of the kneader under vacuum.

In addition, the said organic high polymer mixture is prepared by mixing the said organic high polymer composition and the potassium-based single crystal fiber in the ratio of 100 parts by weight; 2 parts by weight, respectively.

As the potassium-based single crystal fiber used in this example 6 kinds of sample thereof having an average particle size of 0.5μ and having the length of 10μ, 25μ, 50μ, 250μ, 500μ and 600μ, respectively, are prepared. Accordingly, the ratios (L/D) of length to average particle diameter of the fiber for the six samples above is 20, 50, 100, 500, 1000 and 1200, respectively.

The properties of the microwave absorber prepared in this example are measured by ASTM D-648.

Figure 2:
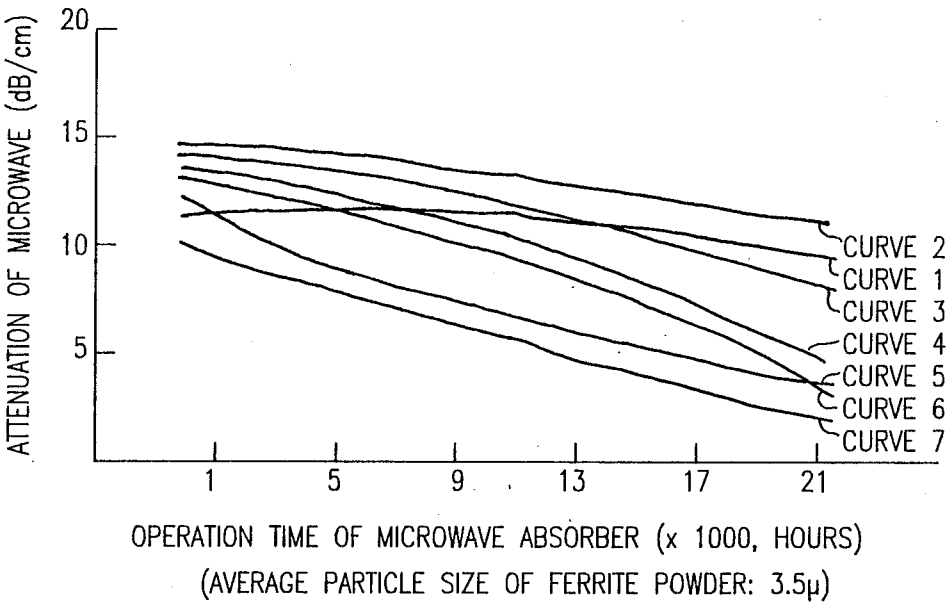
FIGS. 2 and 4 are diagrams showing the relationship between the attenuation of electromagnetic wave and the operating time of the electromagnetic wave absorber according to the potassium-based single crystal fibers used in operating the microwave absorbers of the present invention.
Figure 3:
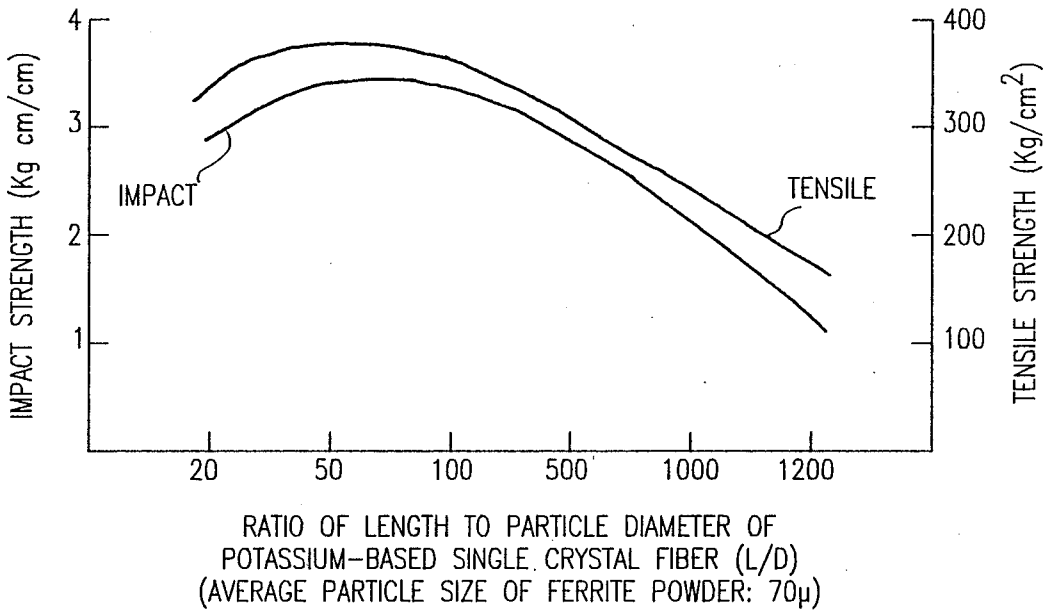

First, in measurement of the heat-resistance the heat distortion temperature obtained is 130° C., when the average particle size of Mn-Zn-ferrite is 3.5μ, and is 115° C., when the average particle size of Mn-Zn-ferrite is 70μ, regardless of the ratio of length to average particle diameter of the potassium-based single crystal fiber. The mechanical strength according to the ratio of length to average particle diameter of the potassium-based single crystal fiber and kind of the particle of Mn-Zn-ferrite employed is shown in FIG. 1 (ferrite powder having a particle size 3.5μ) and FIG. 3 (ferrite powder having a particle size 70μ). In FIG. 2 (ferrite powder having a particle size 3.5μ) and FIG. 4 (ferrite powder having a particle size 70μ), the change of the attenuation of microwave with the passage of the operating time in the microwave heating oven on which the microwave absorber prepared in this example is mounted, is presented. In these two figures, curves 1, 2, 3, 4, 5 and 6 correspond to the samples having the ratio of length to average particle diameter of the potassium fiber of 20, 50, 100, 500, 1000 and 1200, respectively.

As can be seen from the figures, the microwave absorber made from the potassium-based single crystal fiber having a ratio of length to particle diameter thereof in the range of 20 to 100 provides excellent mechanical strength and also exhibits an outstanding microwave attenuation effect when using in the microwave heating oven. In addition, in such case the ferrite powder having an average particle diameter of 3.5μ is more effective than that having an average particle diameter of 70μ.

It will be recognized that the technical effects obtained from the present invention as above are totally superior to those obtained from prior arts.

COMPARATIVE EXAMPLE

As disclosed in Example, two kinds of Mn-Zn-ferrite powder having a size 3.5μ and 70μ, respectively, are prepared. The ferrite powder thus prepared is mixed with an organic high polymer material only containing the organic high polymer composition in a ratio of 4 parts by weight:1 part by weight and then the mixture is injection molded to form a conventional microwave absorber shape ( ⊓⊔ ).

The said organic high polymer material is a mixture of the modified polypropylene resin and the polypropylene resin in the original form, in a ratio of 1 part by volume:4 parts by volume, said modified polypropylene resin being the particle having a diameter of 2 mm to 3 mm and a length of 3 mm to 4 mm, which is prepared by introducing into a biaxial kneader 90% by weight of polypropylene resin, 3% by weight of cis-4-cyclohexane-1,2-dicarboxylic acid anhydride, 4% by weight of an aliphatic diacyl peroxide and 3% by weight of trioctylphosphate and then kneading the mixture at the processing temperature of 220° to 250° C. while maintaining the interior of a cylinder of the kneader under vacuum.

The potassium-based single crystal fibre was not used in this comparative example. The properties of the microwave absorber prepared in this comparative example are measured by ASTM D-648.

In measurement of the heat-resistance, the heat distortion temperature obtained is an average of 120° C. when the average particle size of Mn-Zn-ferrie powder is 3.5μ, and is an average of 105° C. when the size is 70μ.

Figure 4:
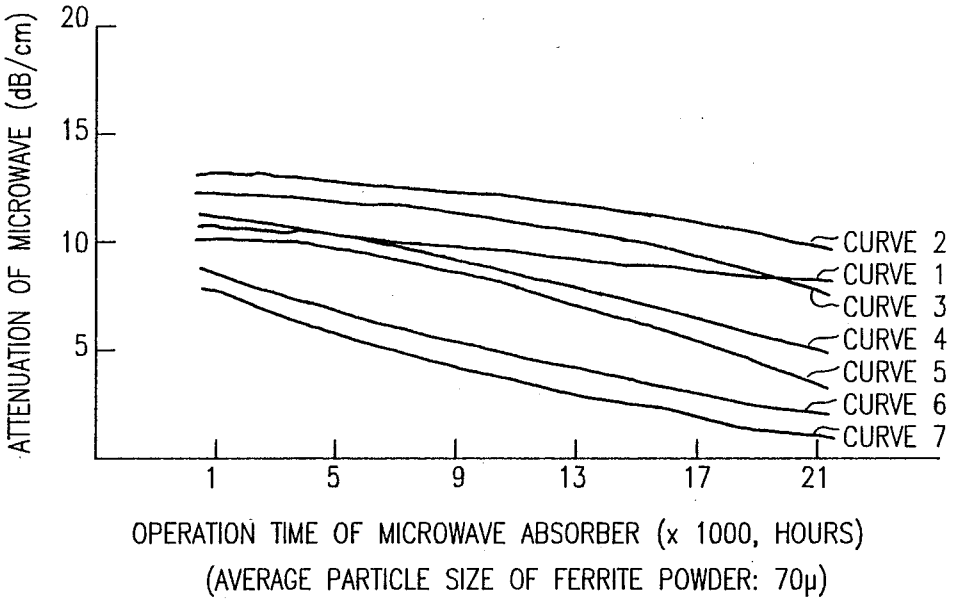

In FIG. 2 (use of ferrite powder having a particle size 3.5μ) and FIG. 4 (use of ferrite powder having a particle size 70μ), the change of the attenuation of microwave with the passage of the operating time in the microwave heating oven on which the microwave absorber prepared in this comparative example is presented as a curve 7.

We claim:

1. A resin composition for absorbing electromagnetic waves which comprises 3 to 5 parts by weight of a ferrite powder and 0.5 to 1.5 part by weight of a polymer mixture, said ferrite powder having the general formula $M_1O.M_2O.Fe_2O_3$ in which $M_1$ and $M_2$ are divalent metal selected from the group consisting of Cu, Zn, Mn, Mg, Ni and Co, and being produced by a mutual combination of $M_1$ and $M_2$, wherein the organic high polymer mixture is prepared by mixing 100 parts by weight of an organic high polymer composition, which is a mixture of a polypropylene resin and a modified polypropylene resin in a ratio of 3 to 5 parts by volume:0.1 to 1 part by volume, with 0.5 to 2 parts by weight of a potassium-based single crystal fiber.

2. The resin composition according to claim 1, wherein the particle size of the ferrite powder is below 100μ.

3. The resin composition according to claim 1, wherein the potassium-based single crystal has a ratio of length to diameter in the range of 20 to 100.

4. The resin composition according to claim 1, the modified polypropylene resin is composed by mixing 90 to 97% by weight of a polypropylene resin with 1 to 5% by weight of an acid compound having carboxyl radical, 1 to 5% by weight of a peroxide compound and 1 to 5% by weight of a phosphate-based stabilizer.

5. A microwave absorbing gasket for microwave oven door made by the composition according to any one of claims 1 or 2.

* * * * *